US012071277B2

(12) United States Patent
Falzoni et al.

(10) Patent No.: US 12,071,277 B2
(45) Date of Patent: Aug. 27, 2024

(54) CAP FOR A CONTAINER HAVING A HINGE

(71) Applicant: SACMI COOPERATIVA MECCANICI IMOLA SOCIETA' COOPERATIVA, Imola (IT)

(72) Inventors: Alessandro Falzoni, Imola (IT); Giulio Fabbri, Barbiano (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 11 days.

(21) Appl. No.: 17/595,912

(22) PCT Filed: May 29, 2020

(86) PCT No.: PCT/IB2020/055101
§ 371 (c)(1),
(2) Date: Nov. 29, 2021

(87) PCT Pub. No.: WO2020/240486
PCT Pub. Date: Dec. 3, 2020

(65) Prior Publication Data

US 2022/0227541 A1 Jul. 21, 2022

(30) Foreign Application Priority Data

May 31, 2019 (IT) ..... 102019000007746

(51) Int. Cl.
*B65D 41/02* (2006.01)
*B65D 41/04* (2006.01)
(Continued)

(52) U.S. Cl.
CPC ..... *B65D 41/0457* (2013.01); *B65D 41/0485* (2013.01)

(58) Field of Classification Search
CPC ..... B65D 41/0457; B65D 41/0485; B65D 41/18; B65D 43/162; B65D 51/243; B65D 51/04; B65D 2251/023
(Continued)

(56) References Cited

U.S. PATENT DOCUMENTS 1,063,384 A * 6/1913 Hubert ..... B65D 51/243 215/305
1,112,880 A * 10/1914 Zonne ..... B65D 51/243 215/305
(Continued)

FOREIGN PATENT DOCUMENTS

DE 102015116784 A1 4/2017
FR 1183399 A 7/1959

*Primary Examiner* — Gideon R Weinerth
(74) *Attorney, Agent, or Firm* — Pearne & Gordon LLP; J. Gregory Chrisman

(57) ABSTRACT

A cap for a container comprises:
- a retaining ring suitable for being associated with a neck of the container;
- a closing element comprising a lateral wall which extends around an axis and a transversal wall which extends transversally to the axis for defining a closed end of the closing element;
- a hinge structure which connects the closing element to the retaining ring, so that the closing element is displaceable between an open position and a closed position.

The closing element comprises a projection which projects from an outer surface of the lateral wall transversally to said axis, the projection extending around said axis by an angle of at least 180°.

12 Claims, 3 Drawing Sheets

(51) Int. Cl.
*B65D 41/18* (2006.01)
*B65D 41/48* (2006.01)
*B65D 55/16* (2006.01)

(58) Field of Classification Search
USPC ..... 215/316, 235, 252, 305, 237, 353, 215/DIG. 1, 382; 220/805, 837; D9/443, D9/446, 452, 453, 454, 449, 447
See application file for complete search history.

(56) References Cited

U.S. PATENT DOCUMENTS 1,706,561 A * 3/1929 Church ..... B65D 51/243 215/328
1,863,081 A * 6/1932 Bellows ..... B65D 51/243 215/305
2,102,440 A 12/1937 Sebell
2,129,873 A * 9/1938 Romati ..... B65D 51/04 220/315
2,546,566 A * 3/1951 Schweizer ..... B65D 41/18 215/250
2,573,552 A * 10/1951 Detzel ..... B65D 41/18 138/96 T
2,750,062 A * 6/1956 Satz ..... B65D 41/425 D9/438
2,958,439 A * 11/1960 Yochem ..... B65D 41/18 220/837
3,187,919 A * 6/1965 Inglis ..... B65D 51/243 D9/443
3,285,451 A * 11/1966 Golde ..... B65D 41/185 215/320
3,382,997 A * 5/1968 Tsuji ..... B65D 51/243 215/253
3,425,580 A * 2/1969 Brockhage ..... B65D 51/243 215/305
3,441,162 A * 4/1969 Julius ..... B65D 41/18 D9/454
3,990,598 A * 11/1976 Zapp ..... B65D 55/16 215/320
4,951,829 A * 8/1990 Hsu ..... B65D 41/42 215/253
4,951,830 A * 8/1990 Cochrane ..... B29C 45/4407 215/256
D491,275 S * 6/2004 Walters ..... B65D 50/062 D24/224
D581,268 S * 11/2008 Heath ..... D9/443
8,808,593 B2 * 8/2014 Guerin ..... B65D 41/48 264/318
10,669,079 B2 * 6/2020 Freedman ..... B65D 53/02
D908,497 S * 1/2021 Delfanti ..... B65D 41/18 D9/453
11,084,635 B2 * 8/2021 Faulkner ..... A61J 1/03
11,325,771 B2 * 5/2022 Freedman ..... B65D 53/02
11,535,436 B2 * 12/2022 Bassi ..... B65D 55/16
2007/0193891 A1 * 8/2007 Portier ..... B65D 79/02 206/459.1
2009/0095699 A1 * 4/2009 Milante ..... B65D 50/062 215/217
2015/0129534 A1 * 5/2015 Falzoni ..... B65D 41/0421 215/316
2015/0246756 A1 * 9/2015 Wampler ..... B65D 41/18 220/805
2015/0368003 A1 * 12/2015 Freedman ..... B65D 43/0216 220/315
2016/0176586 A1 6/2016 Melan-Moutet
2016/0318677 A1 11/2016 Schneider
2018/0362224 A1 * 12/2018 Philip ..... B65D 43/162
2022/0227541 A1 * 7/2022 Falzoni ..... B65D 41/0457
2022/0315290 A1 * 10/2022 Falzoni ..... B65D 41/3447
2022/0340340 A1 * 10/2022 Bassi ..... B65D 55/16
2022/0355988 A1 * 11/2022 Falzoni ..... B65D 41/3428

* cited by examiner

Fig.1
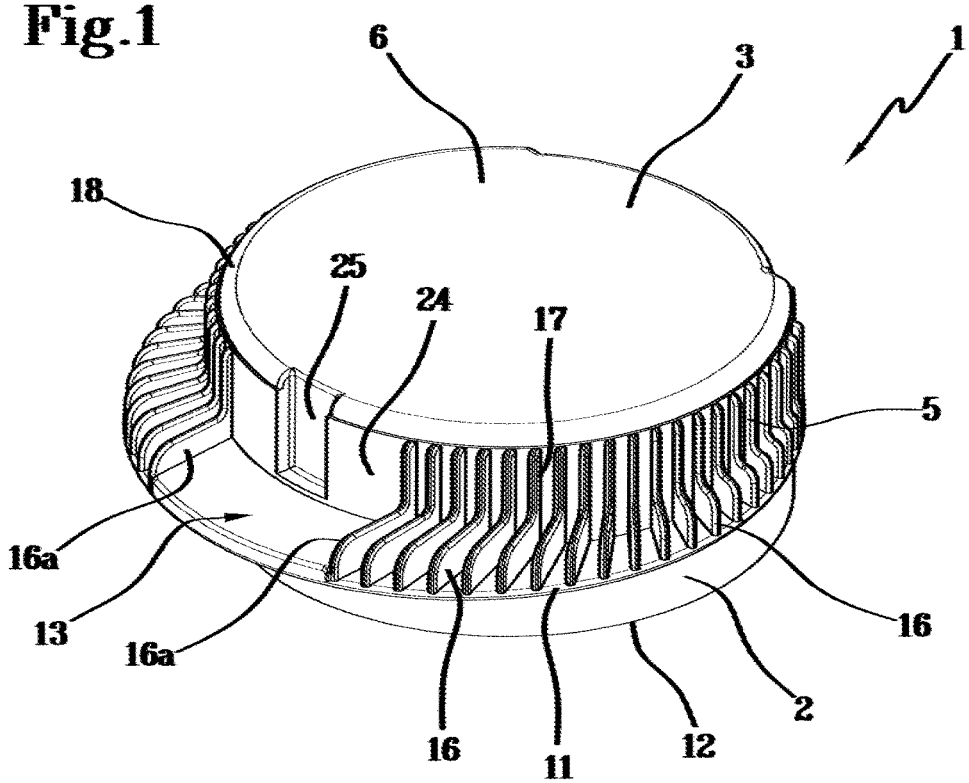
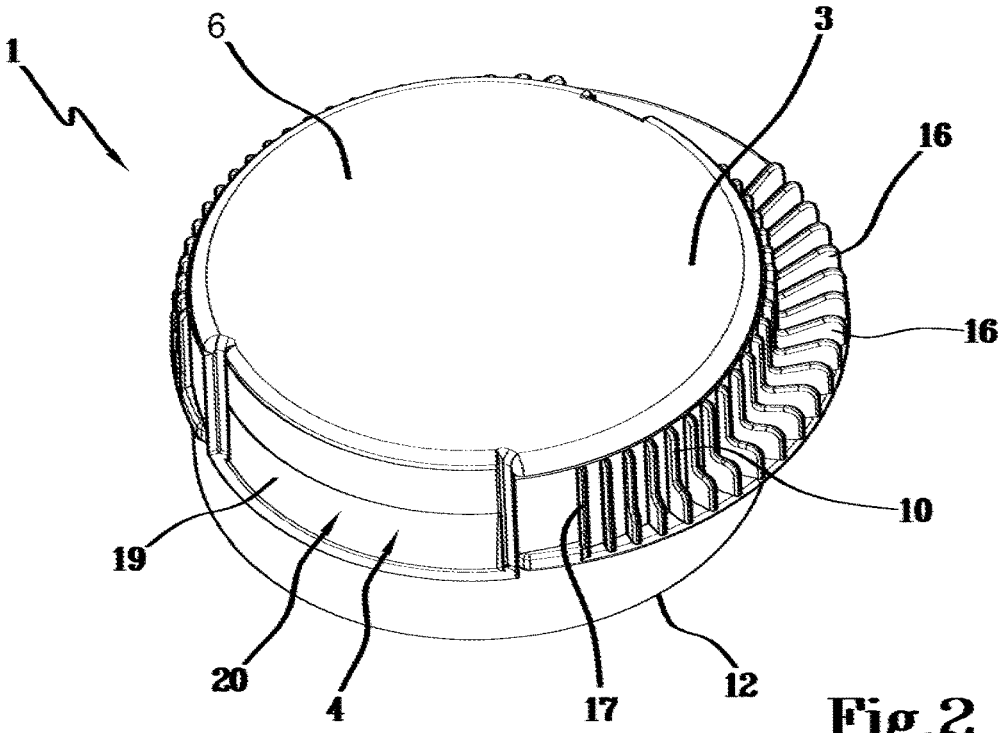
Fig.2

Fig.3
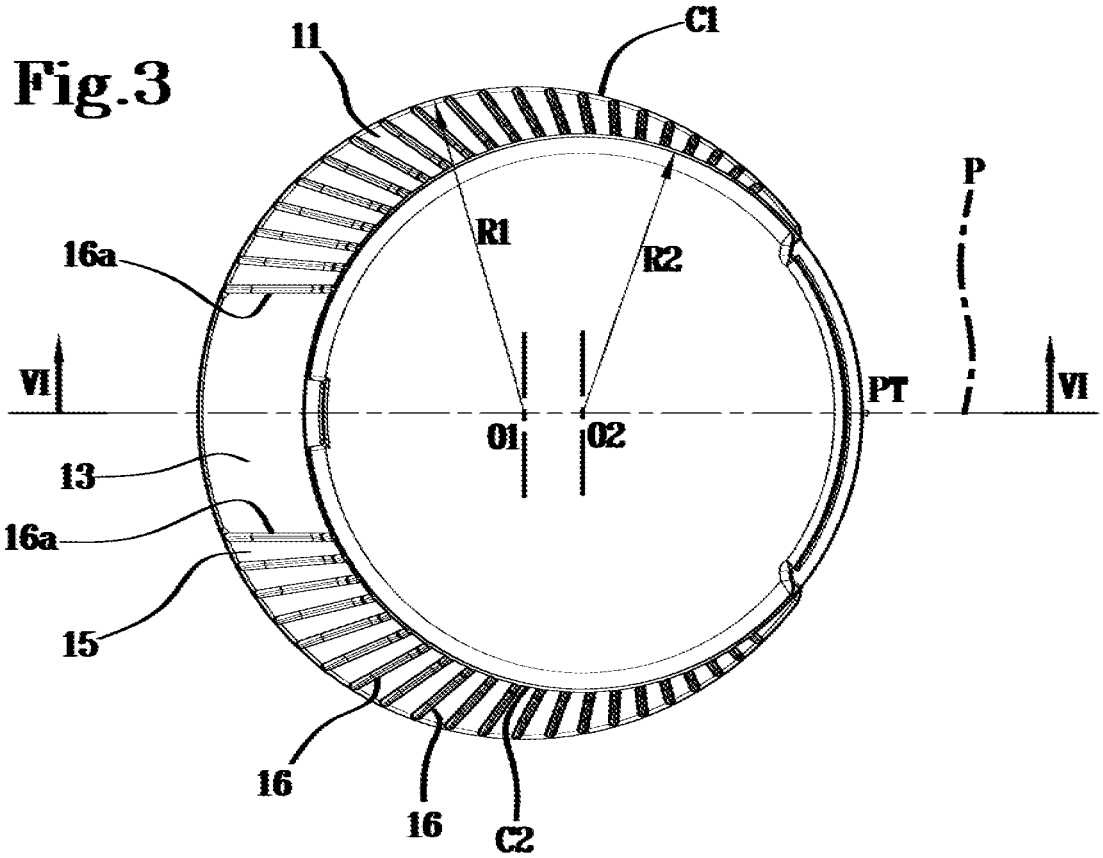
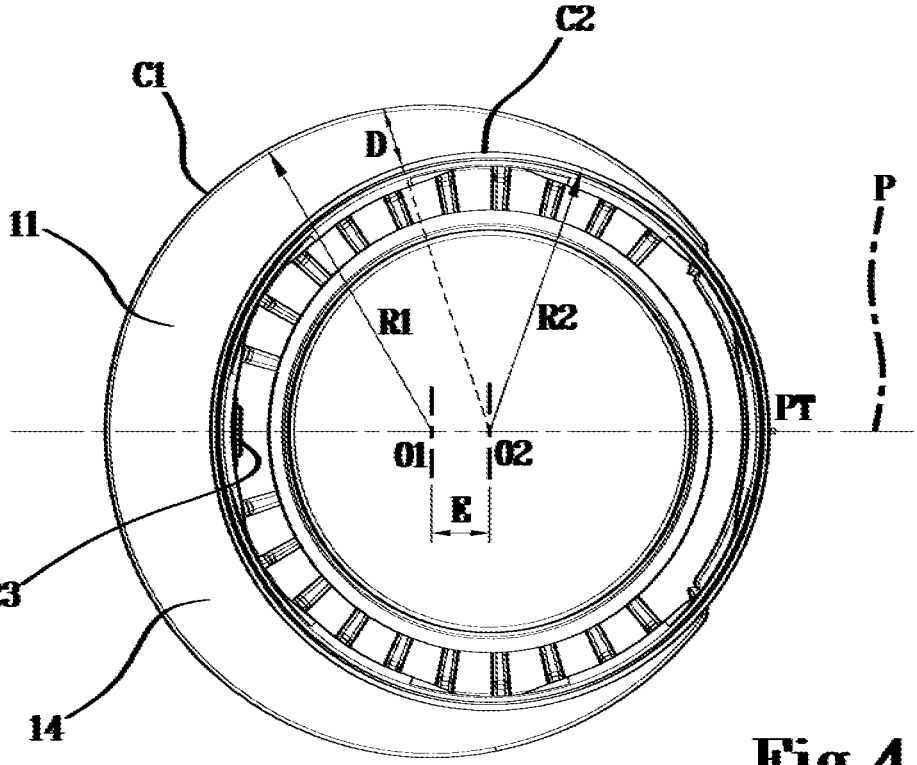
Fig.4

CAP FOR A CONTAINER HAVING A HINGE

The invention relates to a cap with a hinge, which can be used to repeatedly open and close a container such as a bottle. The cap according to the invention can be made of polymeric material and can be obtained with different production methods, for example by compression moulding or injection moulding.

Caps are known which comprise a retaining ring suitable for being associated with a neck of a container and a closing element, connected to the retaining ring by a hinge structure. The closing element can pivot around the hinge structure between a closed position and an open position. In the closed position, the closing element engages with the neck in order to close an opening surrounded by the neck of the container. In the open position, the closing element is disengaged from the neck of the container, so as to allow a substance present in the container to be dispensed.

The closing element may be provided with a tab which projects outwards from a lateral surface of the closing element, in a position diametrically opposite the hinge structure. The user acts on the tab to better displace the closing element between the open position and the closed position. In particular, when the closing element is in the closed position, the user acts on a lower surface of the tab in order to rotate the closing element into the open position. In contrast, when the closing element is in the open position, the user can push on an upper surface of the tab in order to return the closing element to the closed position.

The tab of the prior art caps has an angular extent, around an axis of the closing element, which is quite limited, of roughly 90° or even less. The caps of the type described above are usually provided with inner undercuts, for example at engaging means for keeping the retaining ring associated with the neck of the container, or at projections which, from a lateral wall of the closing element, project towards the inside of the cap, so as to interact with the neck of the container. These undercuts may cause difficulties when the cap must be extracted from a mould in which it has been formed.

Some examples of known caps are disclosed in FR 1183399, U.S. Pat. Nos. 3,990,598, 2,102,440, US 2016/318677.

An object of the invention is to improve the caps for closing a container, in particular the caps of the type comprising a closing element hinged to a retaining ring.

A further object is to provide a cap comprising a closing element hinged to a retaining ring, in which a user can easily displace the closing element between a closed position and an open position.

Another object is to supply a cap comprising a closing element hinged to a retaining ring, which can easily be extracted from a mould in which the cap has been formed.

According to the invention, there is provided a cap for a container, comprising:

- a retaining ring suitable for being associated with a neck of the container;
- a closing element comprising a lateral wall which extends around an axis and a transversal wall which extends transversally to the axis for defining a closed end of the closing element;
- a hinge structure which connects the closing element to the retaining ring, so that the closing element is displaceable between an open position and a closed position;

wherein the closing element comprises a projection which projects from an outer surface of the lateral wall transversally to said axis, the projection extending around said axis by an angle of at least 180°.

The projection which extends around the axis by an angle of at least 180° defines a thrust surface which can be acted on by an extracting element of a mould in which the cap is formed. By acting on that thrust surface, the extracting element can easily extract the cap from the mould, in particular by disengaging the cap from a male mould element with which the cap remains associated after the mould has been opened.

Owing to the significant angular extent of the thrust surface defined by the projection, the extracting element can apply a thrust on a relatively large arc around the axis of the lateral wall of the closing element. This makes it possible to avoid concentrating the extracting force in a zone which is too small, which could result in excessive deformations of the cap or of the projection, and also makes it possible to increase the extracting force which the extracting element is able to apply.

Finally, it is easier for the user to move the closing element between the closed position and the open position, even if a force is applied on the closing element in a region of the projection which is not perfectly centred.

In conclusion, the projection which extends around the axis by an angle of at least 180° allows an increase in the radial dimension of the cap, even for caps intended to be applied on relatively small necks. That allows an increase in the safety of the cap during use, and in particular prevents the possibility of the cap being accidentally swallowed by a child.

It is possible to define a radial dimension of the projection.

The radial dimension can be measured in a plane perpendicular to the axis of the lateral wall, in a radial direction relative to a circle lying in said plane and having a centre on the axis of the lateral wall.

In one embodiment, the radial dimension of the projection is null at least at one point of the hinge structure.

In this way, when the closing element is displaced between the open position and the closed position, it is possible to prevent unwanted interaction of the projection with the hinge structure, which could compromise correct rotation of the closing element.

The radial dimension of the projection may be at its maximum at least at one point of a region of the projection diametrically opposite the hinge structure.

That makes a relatively large surface available to the user, on which the user can act in order to move the closing element between the open position and the closed position.

The radial dimension of the projection may gradually increase from the hinge structure to a region diametrically opposite the hinge structure.

In this way, it is possible to make available a thrust surface having a significant angular extent around the axis of the lateral wall, on which the extracting element of the mould can act to remove the cap from the mould.

In one embodiment, the projection is delimited, in a plan view of the cap (that is to say, in a plane perpendicular to the axis of the lateral wall), by a closed perimetric line which extends around said axis.

In this way a projection is obtained which is substantially free of sharp edges, therefore it is particularly convenient to handle.

The points of the closed perimetric line may be located at respective distances from the axis of the lateral wall, said distances being different from each other depending on the point of the closed perimetric line considered.

That allows the obtainment of a variation in the radial dimensions of the projection around the axis of the lateral wall of the cap, which has been previously mentioned.

In one embodiment, the closed perimetric line is a circle having a centre which lies outside the axis of the lateral wall.

That allows the obtainment of a projection which projects from the lateral wall by a radial dimension variable around the axis of the lateral wall, in a particularly simple way.

In one embodiment, the circle defining the closed perimetric line of the projection is tangent to a further circle defining a closed perimetric line of the lateral wall, in a plan view of the closing element (that is to say, in a plane perpendicular to the axis of the closing element).

More specifically, the above-mentioned circle and further circle may be tangential at a point of the hinge structure, for example at a point lying in a middle plane of the hinge structure.

In this way it is possible to obtain, in a simple and clean way, a projection which does not interfere with the movement of the closing element around the hinge structure, can be easily handled by the user in a position diametrically opposite the hinge structure in order to rotate the closing element, and defines a significant resting surface for the extracting element of the mould.

In one embodiment, the projection projects from a portion of the lateral wall of the closing element which is nearer to the retaining ring than to the transversal wall of the closing element.

That allows the cap to be handled on a capping machine, that is to say, on a machine for applying the cap on a container, of the traditional type.

In particular, between the transversal wall and the projection there is a portion of a skirt of the cap, with which a spindle can engage, the spindle grasping and retaining the cap, then applying the latter on the neck of the container to be closed.

Between the projection and a free edge of the retaining ring a further portion of the skirt of the cap is comprised. A conveying element can engage with said further portion, the conveying element being for example shaped as a recess of a star-wheel conveyor, having the function of conveying the cap between different operating stations.

In one embodiment, the projection is provided with a plurality of stiffening ribs.

The stiffening ribs allow the projection to be stiffened, so that the latter can better withstand the force applied by the extracting element of the mould.

In one embodiment, the stiffening ribs are provided on a surface of the projection facing towards the transversal wall of the closing element.

One part of the surface of the projection facing towards the transversal wall of the closing element, for example arranged in a position diametrically opposite the hinge structure, may be free of stiffening ribs.

That defines a smooth part of the surface of the projection facing towards the transversal wall of the closing element, on which the user can act when he or she wants to move the closing element between the open position and the closed position. This allows the user to more easily identify the part of the projection on which it is appropriate to act in order to rotate the closing element around the hinge structure. Moreover, the smooth part of the surface of the projection makes it easier for the user to apply a pressure on the projection in order to displace the cap from the open position to the closed position, without the fingers being bothered by the stiffening ribs.

In one embodiment, the stiffening ribs provided on the surface of the projection facing towards the transversal wall of the closing element extend in respective planes, each of which is rotated towards the part of the projection free of stiffening ribs relative to a radial plane of the lateral wall of the closing element.

That plane may pass through a point of the lateral wall from which the corresponding stiffening rib projects.

In this way, the stiffening ribs visually indicate to the user which part of the projection to act on in order to displace the closing element between the open position and the closed position, that is to say, the part of the projection which is free of ribs.

In one embodiment, the lateral wall is externally provided with a plurality of gripping ribs, each of which may extend, for example, in a direction parallel to the axis of the lateral wall.

Each gripping rib may define a continuation of a corresponding stiffening rib.

The gripping ribs allow a spindle of the capping machine to securely retain the cap while the latter is applied on the neck of a container to be closed.

The invention may be better understood and implemented with reference to the accompanying drawings, which illustrate an example, non-limiting embodiment of it, in which:

FIG. 1 is a perspective front view of a cap for a container;

FIG. 2 is a perspective rear view of the cap of FIG. 1;

FIG. 3 is a top view of the cap of FIG. 1;

FIG. 4 is a bottom view of the cap of FIG. 1;

FIGS. 1 to 6 show a cap 1 for a container, for example a bottle, which allows the user to open and reclose the container more than once.

The cap 1 comprises a retaining ring 2, suitable for being associated with a neck, not illustrated, of the container closed by the cap 1 in order to retain the cap 1 on the neck.

The cap 1 further comprises a closing element 3, movable between a closed position shown in FIGS. 1 to 6 and an open position not shown, in order to close or alternatively to open an opening surrounded by the neck of the container.

The closing element 3 is hinged to the retaining ring 2, that is to say, is connected to the retaining ring 2 by a hinge structure 4 which will be described in detail below.

The hinge structure 4 allows the closing element 3 to be moved between the closed position and the open position, whilst the retaining ring 2 remains associated with the neck of the container.

Figure 6:
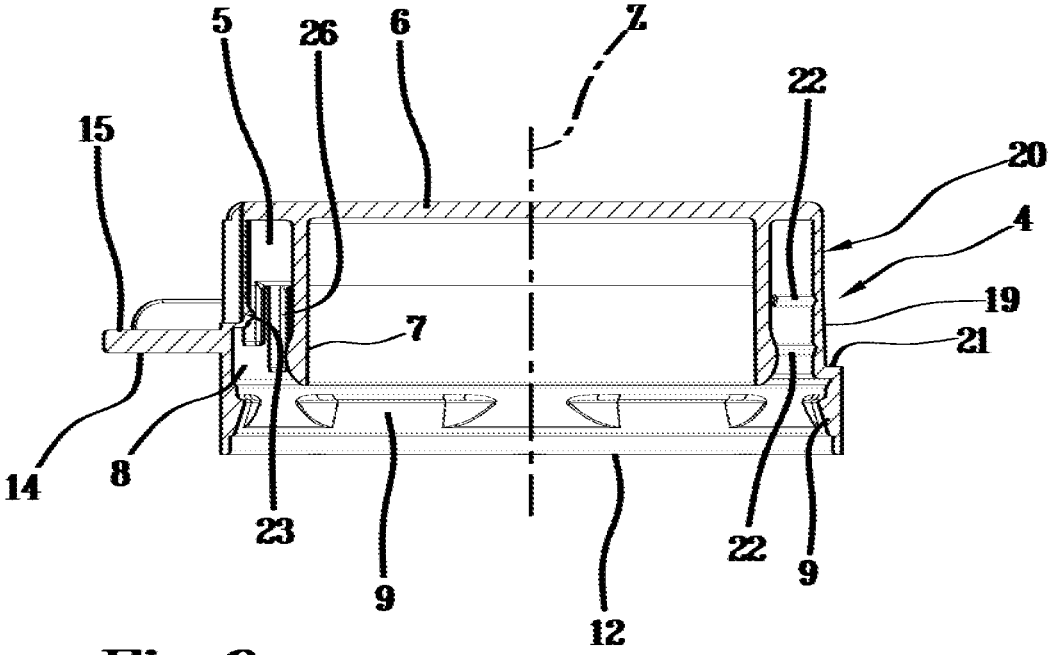
FIG. 6 is a cross-section of the cap of FIG. 1, along the plane VI-Vi of FIG. 3.

The closing element 3 comprises a lateral wall 5, which extends around an axis Z, shown in FIG. 6. The lateral wall 5 may for example have a substantially cylindrical shape.

The closing element 3 further comprises a transversal wall 6, which extends transversally, for example perpendicularly, to the axis Z so as to define a closed end of the closing element 3. The transversal wall 6 may have a substantially circular shape in plan view.

A sealing lip 7, shown in FIG. 6, may project from a surface of the transversal wall 6 facing towards the inside of the cap 1. The sealing lip 7, for example having an annular shape, is suitable for engaging with an inner surface of the neck in order to prevent leaks of the substance contained in the container, or to prevent contaminations of that substance with external substances.

Figure 5:
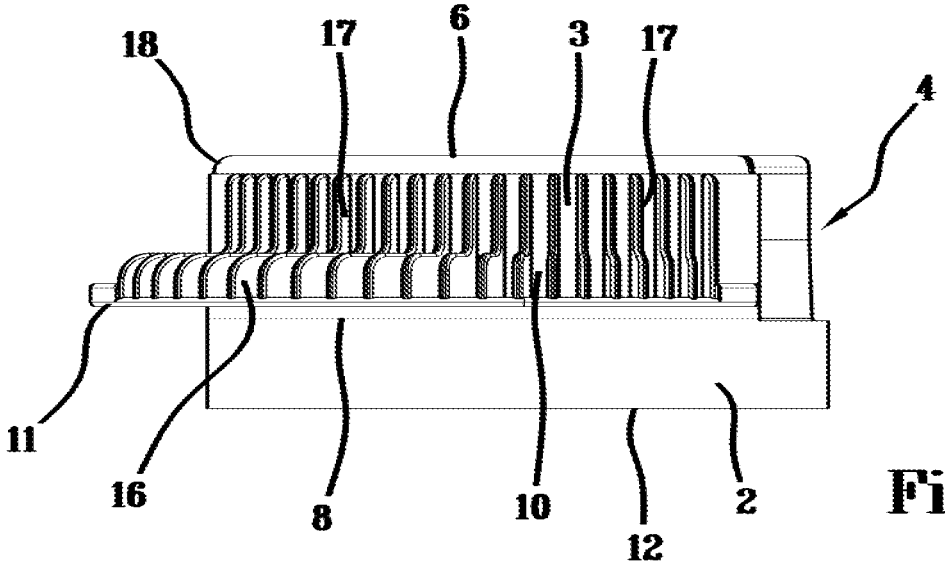
FIG. 5 is a side view of the cap of FIG. 1.

Before the closing element 3 is brought into the open position for the first time, a separating line 8 is defined between the closing element 3 and the retaining ring 2. The separating line 8 is shown in FIGS. 5 and 6. The closing element 3 is separable from the retaining ring 2 along the separating line 8.

The separating line 8 may extend in a plane which, in the closed position of the closing element 3, is arranged transversally, in particular perpendicularly, to the axis Z. However, this configuration is not necessary, and the separating line 8 may also extend on a surface which is not flat.

The separating line 8 has a circumferential extent around the axis Z of less than 360°, because the closing element 3 is joined to the retaining ring 2 at least along the hinge structure 4, as will be described in more detail below.

Along the separating line 8 a plurality of breakable bridges may be provided, suitable for being broken the first time the closing element 3 is brought into the open position, so as to signal to the user if the container closed by the cap 1 has ever been opened.

The separating line 8 delimits an open end of the closing element 3, opposite the closed end, that is to say, the end at which the transversal wall 6 is provided.

The retaining ring 2 comprises an engaging structure provided on an inner surface of the retaining ring 2 for engaging with an annular enlargement made on the neck of the container. In this way, the engaging structure ensures that the retaining ring 2 remains associated with the neck when the closing element 3 is brought into the open position. In particular, the annular enlargement made on the neck interacts with the engaging structure, preventing the retaining ring 2 from being pulled off the neck of the container.

In the example shown, the engaging structure comprises a plurality of protruding elements 9, shown in FIG. 6, which project from the inside of the retaining ring 2 towards the axis Z. Each protruding element 9 is shaped as a local thickening of the retaining ring 2.

In an alterative embodiment not shown, the engaging structure may have other geometries. For example, the engaging structure may be shaped as a plurality of tabs which extend from a free edge of the retaining ring 2 and are bent towards the inside. Alternatively, the engaging structure may be shaped as a single continuous tab which, from the free edge of the retaining ring 2, is bent towards the inside of the cap 1.

The retaining ring 2 has a free edge 12 arranged on the opposite side to the separating line 8.

In the closed position, the lateral wall 5 and the retaining ring 2 define a skirt 10 of the cap 1, the skirt 10 extending around the axis Z.

In the closed position, the retaining ring 2 extends around the axis Z and is coaxial with the lateral wall 5.

The closing element 3 comprises a projection 11, which projects from an outer surface of the lateral wall 5 outwards from the cap 1. The projection 11 extends transversally, for example perpendicularly, to the axis Z.

The projection 11 has an angular extent of at least 180° around the axis Z.

In particular, the projection 11 may have an angular extent of approximately 270°-300° around the axis Z.

In plan view (that is to say, in a view in a plane perpendicular to the axis Z, when the closing element 3 is in the closed position), the projection 11 is delimited by a perimeter which, in the example shown, is circular, in more detail shaped as a circle C1 (or as a portion of a circle C1) having a centre O1 and a radius R1.

In the plan view, the skirt 10 is delimited by a perimeter which, in the example shown is shaped as a further circle C2 having a centre O2 and a radius R2. Indeed, the skirt 10 has a substantially cylindrical geometry.

The radius R2 of the further circle C2 is smaller than radius R1 of the circle C1. In this way, the projection 11 projects radially from the skirt 10, in particular from the lateral wall 5.

The centre O1 of the circle C1 does not coincide with the centre O2 of the further circle C2, instead it is placed at a distance E from the centre O2 of the further circle C2. Therefore, the circle C1 is arranged in an eccentric position relative to the further circle C2 and E is the eccentricity between the two circles.

The further circle C2 is arranged inside the circle C1 and may be tangent to the circle C1 at a tangent point PT.

In the example shown, the tangent point PT is located at the hinge structure 4, in particular in a middle plane P of the hinge structure 4, whose trace is shown in FIGS. 3 and 4.

The further circle C2 may define the perimeter, in plan view, of the retaining ring 2, or of the lateral wall 5. If the lateral wall 5 is not delimited by a smooth cylindrical surface, but instead by a surface which has for example ribs or other irregularities, the further circle C2 which perimetrically delimits the lateral wall 5 may be the circle in which the outer contour of the lateral wall 5 is inscribed, no matter how the latter is shaped.

It is possible to define a radial dimension D of the projection 11. The radial dimension D of the projection 11 varies according to the particular point of the projection 11 considered.

Between the points which are located along the perimeter of the projection 11, that is to say, along the circle C1 in the example shown, and an outer surface of the skirt 10 there is a distance equal to the radial dimension D, which is measured in a radial direction relative to the further circle C2, that is to say, along a straight line passing through the point considered and through the centre O2 of the further circle C2. Therefore, the radial dimension D indicates how far the projection 11 projects from the skirt 10, in particular from the lateral wall 5.

The radial dimension D of the projection 11 is not constant. In the example shown, the radial dimension D of the projection 11 is at its maximum at a point diametrically opposite the tangent point PT. In contrast, the radial dimension is null at the tangent point PT as well as, in the example shown, along the hinge structure 4.

Providing a radial dimension D of the projection 11 which is null, or almost null, at the hinge structure 4, prevents the projection 11 from obstructing rotation of the closing element 3 around the hinge structure 4, when the closing element 3 passes from the closed position to the open position or vice versa.

The radial dimension D of the projection 11 gradually increases from the hinge structure 4 towards a region diametrically opposite the hinge structure 4.

In an embodiment not shown, rather than being delimited by a circular perimeter, the projection 11 could be delimited by any other perimetric line which extends around the axis Z, in particular a closed perimetric line, for example oval or elliptical.

The projection 11 projects from an intermediate zone of the skirt 10, that is to say, from a zone of the skirt 10 arranged in an intermediate position between the transversal wall 6 and the free edge 12 of the retaining ring 2.

In particular, the projection 11 may project from the lateral wall 5 in a position nearer to the separating line 8 than to the transversal wall 6.

The projection 11 allows a user to easily move the closing element 3 between the closed position and the open position, thereby opening or alternatively closing the container on which the cap 1 is applied. For that purpose, the user acts on a front part 13 of the projection 11, the front part 13 being arranged in a position diametrically opposite the hinge structure 4.

In particular, when the user wants to displace the closing element 3 from the closed position to the open position, he or she pushes with a finger below the front part 13, in order to rotate the closing element 3 around the hinge structure 4 towards the open position. In contrast, when the user decides to return the closing element 3 to the closed position, he or she can apply a force on a surface of the front part 13 facing towards the transversal wall 6.

The cap 1, which is made of polymeric material, can be formed inside a mould, for example by compression moulding or injection moulding.

The mould in which the cap 1 is formed comprises a male mould element provided with a punch, suitable for shaping an inner surface of the cap 1.

The mould further comprises a female mould element provided with a cavity in which an outer surface of the cap 1 can be shaped.

When the cap 1 has been formed, undercut zones are created inside it which may comprise, for example, the engaging structure made on the retaining ring 2, parts of the sealing lip 7, or other elements which may project from the inside of the skirt 10. Due to the undercut zones present inside the cap 1, after the mould has been opened by moving the punch and the female mould element away from each other, the cap 1 remains anchored to the punch. In order to detach the cap 1 from the punch, the mould comprises an extracting element, which may be shaped as a sleeve surrounding the punch and is movable relative to the punch.

When the cap 1 is produced inside the mould, the extracting element acts on the projection 11, by applying a force in a direction parallel to the axis Z, so as to detach the cap 1 from the punch. Therefore, the projection 11 makes available a relatively large thrust surface on which the extracting element can act in order to remove the cap 1 from the punch. That allows the force applied by the extracting element to be distributed on a considerable surface and, consequently, reduces the risks of unwanted deformation or even breakage which the cap 1 could be subject to if an excessive extracting force were applied to it.

The projection 11 is delimited, on the side facing towards the retaining ring 2, by a lower surface 14 which, in the example shown, is substantially flat.

The lower surface 14 may extend in a plane arranged transversally, in particular perpendicularly, to the axis Z. The lower surface 14 may be smooth, in particular free of ribs.

When the mould in which the cap 1 has been produced is opened, the extracting element acts on the lower surface 14 of the projection 11.

Therefore, the lower surface 14 may be defined as a thrust surface on which the extracting element applies a force suitable for detaching the cap 1 from the punch.

The projection 11 is furthermore delimited, on the side facing towards the transversal wall 6, by an upper surface 15 which may extend in a plane arranged transversally, in particular perpendicularly, to the axis Z.

The adjectives "lower" and "upper" are intended here as referring to the position that the cap 1 adopts when it is applied to a container resting on a horizontal surface and when the closing element 3 is in the closed position.

Those adjectives do not necessarily refer to the position of the cap 1 in the mould, since that position may be upside-down relative to the position of the cap 1 during use.

In the example shown, the projection 11 is provided with a plurality of stiffening ribs 16, suitable for increasing the stiffness of the projection 11 in order to reduce the risks that the projection 11 will deform excessively when the extracting element acts on the cap 1. The stiffening ribs 16 are provided on the upper surface 15 of the projection 11, that is to say, on the opposite surface to that on which the extracting element acts.

In the front part 13 of the projection 11, on which the user acts in order to displace the closing element 3 between the open position and the closed position, the stiffening ribs 16 are absent. Therefore, the front part 13 is delimited, on its face facing towards the transversal wall 6, by a substantially smooth surface. In this way, the user, when observing the cap 1 with the closing element 3 arranged in the closed position, immediately identifies—thanks to the absence of the stiffening ribs 16—which part of the projection 11 is appropriate to act on in order to open the container.

Each stiffening rib 16 lies in a respective plane arranged transversally, in particular perpendicularly, to the upper surface 15 of the projection 11.

The planes in which the stiffening ribs 16 lie, or at least some of these planes, are not arranged radially relative to the circle C1 and/or to the further circle C2. As shown in FIG. 3, the plurality of stiffening ribs 16 comprises two stiffening ribs **16*a* nearest the front part 13 and which delimit the front part 13 on opposite sides. In the example shown, the stiffening ribs 16*a* are substantially parallel to a middle plane of the cap 1, which may be a plane of symmetry of the cap 1. The stiffening ribs 16*a* delimit the front part 13** on opposite sides of this middle plane.

The stiffening ribs **16*a*** may be defined as end stiffening ribs.

The middle plane of the cap 1 may coincide with the middle plane P of the hinge structure 4.

The end stiffening ribs **16*a*** extend on respective planes parallel to the axis Z.

At least some of the planes in which the remaining stiffening ribs 16 lie are rotated towards the front part 13 relative to corresponding radial planes passing through the centre of the further circle C2. In other words, the plurality of stiffening ribs comprises, in addition to the end stiffening ribs **16*a*, further ribs 16 lying in respective planes parallel to the axis Z. Each plane parallel to the axis Z defined by a further rib 16 forms a respective angle with a plane defined by the nearest end stiffening rib 16*a*. The angles thus defined increase moving from the front part 13 towards the hinge structure 4. At least some of planes mentioned above, defined by the further ribs 16**, are not radial, i.e. do not contain the axis Z.

In this way, the stiffening ribs 16 give the user a visual directional impression, almost as if the stiffening ribs 16 were converging towards the front part 13. In this way, it is possible to focus the attention of the user on the front part 13, so that the user understands that the front part 13 is the part of the projection 11 on which it is appropriate to act in order to open or to close the container.

Other orientations and/or arrangements of the stiffening ribs 16 are possible. In an embodiment which is not shown, the stiffening ribs 16 could be provided on the inner surface 14, instead of being provided on the upper surface 15, or in addition to those present on the upper surface 15.

The closing element 3 may have a plurality of gripping ribs 17, arranged on an outer surface of the lateral wall 5 and directed, for example, parallel to the axis Z.

The gripping ribs 17 may extend along the entire height of the lateral wall 5 between the projection 11 and a connecting zone 18 along which the lateral wall 5 is joined to the transversal wall 6. The connecting zone 18 may be shaped as a rounded surface.

In an embodiment not shown, the gripping ribs 17 may be present also in the connecting zone 18.

In the example shown, each gripping rib 17 is the continuation, along the lateral wall 5, of a corresponding stiffening rib 16.

As shown in FIG. 1, in the example shown the gripping ribs 17 are not present in una front region 24 of the lateral wall 5. The front region 24 is diametrically opposite the hinge structure 4. In particular, the front region 24 is arranged above the front part 13 of the projection 11 on which the stiffening ribs 16 are not present. That is to say, the front region 24 is aligned with the front part 13, relative to the axis Z.

In an embodiment not shown, the gripping ribs 17 may be absent.

The gripping ribs 17, if present, make gripping the cap 1 easier for a spindle of a machine which applies the cap 1 on a container.

As shown in FIG. 2, the hinge structure 4 may comprise a hinge band 19 for connecting the closing element 3 to the retaining ring 2. The hinge band 19 may be provided in a recess 20 made in the skirt 10. In other words, the hinge band 19 may be delimited by a portion of a cylindrical surface having a radius smaller than the radius of the outer surface of the retaining ring 2 and/or of the lateral wall 5.

In the example shown, the recess 20 extends up to the transversal wall 6.

A step 21, shown in FIG. 6, is defined between the hinge band 19 and the retaining ring 2.

On an inner surface of the hinge band 19 two lines of weakness 22 may be provided, which are shown in FIG. 6. The lines of weakness 22 may be shaped as lines at which the hinge band 19 has a reduced thickness compared with the surrounding zones. In particular, the lines of weakness 22 may be shaped as grooves which extend on an inner surface of the hinge band 19.

The lines of weakness 22 define sequential lines of rotation around which the closing element 3 rotates, in sequence, in order to pass from the open position to the closed position or vice versa.

The closing element 3 has a locking protuberance 23, shown in FIGS. 4 and 6, suitable for engaging with the neck of the container in order to keep the closing element 3 in the closed position. The locking protuberance 23 projects towards the inside of the cap 1 from an inner surface of the lateral wall 5, in a position diametrically opposite the hinge structure 4. In particular, the locking protuberance 23 may be intersected by the middle plane P of the hinge structure 4. The locking protuberance 23 is, in use, arranged at a level higher than the projection 11, that is to say, it is arranged in a position nearer to the transversal wall 6 than the projection 11.

The locking protuberance 23 may be configured to engage, in the closed position, below a ridge which projects outwards from the neck of the container. In this way, the closing element 3 cannot be brought into the open position, unless the closing element 3 is subjected to a predetermined minimum force, sufficient to disengage the locking protuberance 23 from the neck. This reduces the risk of accidental opening of the container closed by the cap 1.

Moreover, the locking protuberance 23, at the moment when it engages with the neck, may generate a vibration, that can be accompanied by a noise such as a "click", which can be perceived by the user. In this way, the user can be sure that the closing element 3 has been correctly brought into the closed position. The vibration may also be generated when the locking protuberance 23 disengages from the neck, so that the closing element 3 can be displaced to the open position.

The locking protuberance 23 is arranged, on the inside of the cap 1, at the front region 24 of the lateral wall 5. On an outer surface of the lateral wall 5, in a position corresponding to the locking protuberance, there may be a hollow 25. The hollow 25 may be positioned at the centre of the front region 24, for example so that it is intersected by the middle plane P of the hinge structure 4. The hollow 25 may extend up to the transversal wall 6.

The cap 1 is particularly simple to make, by moulding of polymeric material.

At the end of the moulding step, the extracting element of the mould can easily detach the cap 1 from the punch, by acting on the surface of the projection 11 facing towards the retaining ring 2.

The cap 1 can then be subjected to a cutting operation, during which the skirt 10 is cut to obtain the separating line 8. The cutting operation allows to define the breakable bridges arranged along the separating line 8. In particular, the breakable bridges may be identified at axial ribs 26, one of which is shown in FIG. 6, which project towards the inside of the cap 1 from an inner surface of the skirt 10. The axial ribs 26 are arranged parallel to the axis Z. The axial ribs 26 are arranged straddling the retaining ring 2 and the lateral wall 5.

By adjusting the cutting depth of a blade which cuts the skirt 10 in order to obtain the separating line 8, it is possible to prevent the blade from interacting with the axial ribs 26, so that the axial ribs 26 create the breakable bridges which join the retaining ring 2 to the closing element 3, before the latter is brought into the open position for the first time.

The blade which creates the separating line 8 may interact with the skirt 10 along an angle of 360° around the axis Z, without damaging the hinge structure 4. Indeed, if the blade and the cap 1 rotate relative to each other by an angle of 360° around the axis Z, the blade passes in the recess 20 without interfering with the hinge band 19, that is to say, without cutting the hinge band 19.

That simplifies production of the separating line 8, because there is no need to ensure that the cut is only made in a predetermined angular position.

However, the hinge structure 4 could also have a shape different from that described above.

After the separating line 8 has been made, the cap 1 may be applied on the neck of the container which is to be closed. That can be done by a capping machine of the traditional type. In particular, traditional capping machines comprise a spindle which can grip a portion of the skirt 10 interposed between the projection 11 and the transversal wall 6 in order to apply the cap 1 on the container. The stiffening ribs 17, if present, facilitate gripping of the cap 1 by the spindle.

The capping machine may further comprise a conveying device suitable for conveying the cap 1 along a desired path. The conveying device may comprise a star-wheel conveyor which engages with a further portion of the skirt 10 arranged between the projection 11 and the free edge 12 of the retaining ring 2.

Finally, the projection 11 allows an increase in the radial dimensions of the cap 1, even when the latter is intended to be applied on a neck having a relatively small diameter. In this way, it is possible to reduce or even eliminate the risk that the cap 1 may be accidentally swallowed by a child, if the whole cap 1 or only the closing element 3 were erroneously removed from the container. Therefore, the cap 1 is particularly safe during use.

The invention claimed is:

1. A cap to be applied on a neck of a container comprising:

a retaining ring suitable for being associated with the neck of the container;

a closing element comprising a lateral wall which extends around an axis and a transversal wall which extends transversally to the axis for defining a closed end of the closing element;

a hinge band structure;

wherein the closing element comprises a projection which projects from an outer surface of the lateral wall transversally to said axis, the projection extending around said axis by an angle of at least 180°, wherein the projection projects from the lateral wall by a radial dimension, the radial dimension being variable around the axis, the radial dimension gradually increasing from the hinge band structure to a region diametrically opposite the hinge structure;

wherein the projection has, in a plane perpendicular to said axis, a circular perimeter defined by a circle having a centre which lies outside of said axis; and the projection is provided with a provided with a plurality of stiffening ribs extending on a surface of the projection facing towards the transversal wall, the plurality of stiffening ribs comprises two end stiffening ribs which delimit the front part on opposite sides and extend in respective planes parallel to the axis, the plurality of stiffening ribs comprising further ribs lying in respective further planes parallel to the axis which do not contain the axis, the further planes forming, with a plane defined by the nearest end stiffening rib, respective angles which increase from the front part to the hinge band structure; and the stiffening ribs being absent in a front part arranged in a position diametrically opposite the hinge band structure.

2. A cap according to claim 1, wherein the radial dimension is at its maximum at least at one point of a part of the projection arranged in a position diametrically opposite the hinge band structure, the radial dimension being at its minimum at least at one point of the hinge band structure.

3. A cap according to claim 2, wherein the radial dimension is null at least at one point of the hinge structure.

4. A cap according to claim 1, wherein the projection is delimited, in a plane perpendicular to said axis, by a closed perimetric line which extends around said axis.

5. A cap according to claim 1, wherein at a tangent point said circle is tangent to a further circle which delimits an outer contour of the lateral wall, in a plane perpendicular to said axis.

6. A cap according to claim 5, wherein the tangent point is arranged in an angular position, around said axis, corresponding to the hinge structure.

7. A cap according to claim 5, wherein the tangent point lies in a middle plane of the hinge structure.

8. A cap according to claim 1, wherein the projection projects from a portion of the lateral wall which is nearer to the retaining ring than to the transversal wall.

9. A cap according to claim 1, wherein the two end stiffening ribs extend in respective planes parallel to a middle plane of the hinge structure.

10. A cap according to claim 1, wherein the lateral wall is externally provided with a plurality of gripping ribs, each of which defines a continuation of a corresponding stiffening rib.

11. A cap according to claim 10, wherein the gripping ribs are absent in a front region of the lateral wall, the front region being arranged in a position diametrically opposite the hinge structure.

12. A cap according to claim 11, wherein a locking protuberance projects from an inner surface of the lateral wall, the locking protuberance being arranged in a position diametrically opposite the hinge structure for engaging with the neck of the container and keeping the closing element in the closed position, a recess being provided on an outer surface of the lateral wall in a position angularly corresponding to the locking protuberance.

* * * * *